US006945639B2

(12) United States Patent
Lee

(10) Patent No.: US 6,945,639 B2
(45) Date of Patent: Sep. 20, 2005

(54) AUTOMATIC INK SUPPLY DEVICE

(75) Inventor: Jung-Hyun Lee, Seoul (KR)

(73) Assignee: Taeil System Co., Ltd., Seoul (KR)

( * ) Notice: Subject to any disclaimer, the term of this patent is extended or adjusted under 35 U.S.C. 154(b) by 73 days.

(21) Appl. No.: 10/456,393

(22) Filed: Jun. 5, 2003

(65) Prior Publication Data

US 2004/0257411 A1 Dec. 23, 2004

(30) Foreign Application Priority Data

Feb. 12, 2003 (KR) ..... 10-2003-0008733

(51) Int. Cl.[7] ..... B41J 2/175
(52) U.S. Cl. ..... 347/85
(58) Field of Search ..... 347/84, 85, 86, 347/87

(56) References Cited

U.S. PATENT DOCUMENTS 5,367,382 A * 11/1994 Bhatt et al. ..... 358/403
6,172,695 B1 * 1/2001 Liu ..... 347/85
6,199,975 B1 * 3/2001 Baitz et al. ..... 347/85
6,199,976 B1 * 3/2001 Sasada ..... 347/85
6,281,916 B1 * 8/2001 VanSteenkiste ..... 347/85
6,478,415 B2 * 11/2002 Barinaga et al. ..... 347/85

FOREIGN PATENT DOCUMENTS

JP 7017046 A * 1/1995 ..... B41J/2/175

* cited by examiner

*Primary Examiner*—Anh T. N. Vo
(74) *Attorney, Agent, or Firm*—Jordan and Hamburg LLP

(57) ABSTRACT

The present invention discloses an automatic ink supply device comprising: a main body installed in the one side of a printer, including a bottom supporting plate and a top supporting plate of a predetermined height with multiple supporting holes in the inside of the main body; multiple bottom tanks supported in stable in the state of penetrating the corresponding supporting holes of the bottom supporting plate, including a close cap in the top side, including a hose hole in the center of the close cap, including a nozzle hose from the inner bottom side of the close cap to the outside of the main body, and including a nozzle in the end of the corresponding nozzle hose connected to the printer, respectively; and multiple top tanks supplied by ink with different colors from one another in the state of penetrating the supporting holes of the top supporting plate, including a supply hose with an O/C (open/close) valve in the bottom side, maintaining an amount of charged ink constantly in the corresponding bottom tank by prolonging the bottom end of the supply hose to a predetermined height of the inside of the corresponding bottom tank, including an O/C (open/close) cover in the top side to receive ink from the outside, respectively.

10 Claims, 5 Drawing Sheets

AUTOMATIC INK SUPPLY DEVICE

BACKGROUND OF THE INVENTION

1. Field of the Invention

The present invention relates to an automatic ink supply device for a large printer, and more particularly a device utilizing an atmospheric pressure to supply ink for a large printer constantly and automatically, without help of other supplementary equipment, such as a pump or a sensor. In more, the automatic ink supply device of the present invention maintains constant level of ink at a top tank and a bottom tank, while the ink from the external ink source is supplied to the top tank, and while the bottom tank is connected with the top tank. Therefore, it is not necessary to interrupt printing operation of a printer to exchange an ink cartridge.

2. Description of the Related Art

Generally, printing operation of the large printer utilizes piezo method to supply ink to the large printer, while a pump is used to pump a predetermined amount of ink. In this printing method, a sensor is necessary to supply adequate amount of ink to the large printer because a head and an ink cartridge are separated. In more, such printer is complicate, expensive and consumes large amount of ink.

To overcome such problems, Korean Patent No. 20-194011 discloses an automatic ink supply device utilizing an atmospheric pressure to supply ink for a printer continuously. By referring to FIG. 1, a hose 8 having an O/C (open/close) valve 16 connects an ink supply source 2 with an ink cartridge 6 installed in a piezo-jet printer, while the volume of the ink supply source 2 is as big as a few to a few times of that of the ink cartridge 6. In more, by utilizing the height difference H between the ink supply source 2 and the ink cartridge 6, and by utilizing an atmospheric pressure functioning to the ink supply source 2, the level of ink 10 of the ink cartridge 6 is maintained constantly.

In this case, the height difference H between the ink supply source 2 and the ink cartridge 6 is about 35 mm so that the height of the bottom side of a head 12 of the ink cartridge 6 splaying the ink 10 is higher than the height of the ink outlet of the ink supply source 2. Therefore, an adequate amount of ink 22 of the ink supply source 2, as equal as the amount of ink consumed in the ink cartridge 6, is supplied to the ink cartridge 6 automatically through the hose 8.

However, in such a conventional automatic ink supply device, because the volume of the ink supply source 2 is as big as a few to a few times of that of the ink cartridge 6, it is hard to prepare such large space to install the ink supply source 2. In more, after consuming the ink 22 of the ink supply source 2 completely, it is nervous to exchange the empty ink supply source 2 with other full charged ink supply source 2.

SUMMARY OF THE INVENTION

To overcome the above described problems, a preferred embodiment of the present invention provides an automatic ink supply device of a minimized volume installed easily with a large printer, and receiving ink easily and continuously from an ink supply source through a bottom tank and a top tank. In this case, the bottom tank is connected with multiple nozzle hoses and the top tank is connected with multiple supply hoses.

Other purpose of the present invention is to provide an automatic ink supply device adapted to various heights of all kinds of printers, by adjusting the height of the automatic ink supply device in free. In more, the automatic ink supply device prevents the nozzles from closing in advance, by equipping a filter in the inside of the top tank supplied ink from the outside to eliminate a foreign substance from ink.

The present invention provides an automatic ink supply device comprising: a main body installed in the one side of a printer, including a bottom supporting plate and a top supporting plate of a predetermined height with multiple supporting holes in the inside of the main body; multiple bottom tanks supported in stable in the state of penetrating the corresponding supporting holes of the bottom supporting plate, including a close cap in the top side, including a hose hole in the center of the close cap, including a nozzle hose from the inner bottom side of the close cap to the outside of the main body, and including a nozzle in the end of the corresponding nozzle hose connected to the printer, respectively; and multiple top tanks supplied by ink with different colors from one another in the state of penetrating the supporting holes of the top supporting plate, including a supply hose with an O/C (open/close) valve in the bottom side, maintaining an amount of charged ink constantly in the corresponding bottom tank by prolonging the bottom end of the supply hose to a predetermined height of the inside of the corresponding bottom tank, including an O/C (open/close) cover in the top side to receive ink from the outside, respectively.

In more, the present invention further comprises a supporting rod in the bottom of the main body in a predetermined distance apart to be adjusted to match the height of the printer.

In more, the supporting rod further comprises: a top supporting rod fixed in the bottom side of the main body; a bottom supporting rod guided into the inside of the top supporting rod; a base plate supporting the bottom supporting rod in stable; and a fixing bolt in the one side of the top supporting rod to be contacted with the bottom supporting rod.

In more, the present invention comprises an elevating mean between the supporting rods to lift up and down the main body, wherein the elevating mean further comprises: a screw rod in the bottom center of the main body; a screw axis in the base plate to be rotated in a fixed position to the inside of the screw rod to lift up and down the screw rod; and a adjusting handle rotating the screw axis.

In more, the base plate further comprises multiple casters to move the main body easily.

In more, the present invention further comprises a filter unit in a supply hose of the inside of the top tank to filter a foreign substance within the injected ink.

In more, the present invention further comprises an opening to adjust the O/C valve from the outside of the front of the main body.

In more, the front side of the main body is covered with transparent material to identify the amount of ink charged in both top and bottom tanks.

In more, the top side of the maim body further comprises the body cover opened or closed by a rear hinge In more, the present invention further connects the end of the nozzle hose with the nozzle connected to the printer, wherein: the shape of nozzle cartridge is the same of the shape of the ink cartridge; the nozzle hose is fixed to the nozzle cartridge in stable; and the nozzle of the end of the nozzle hose is combined and fixed with the one end of the nozzle cartridge.

BRIEF DESCRIPTION OF THE DRAWINGS

For a more complete understanding of the present invention and the advantages thereof, reference is now made to the following descriptions taken in conjunction with the accompanying drawings, in which like reference numerals denote like parts, and in which.

DETAILED DESCRIPTION OF PREFFERED EMBODIMENTS

Reference will now be made in detail to preferred embodiments of the present invention, example of which is illustrated in the accompanying drawings.

Figure 1:
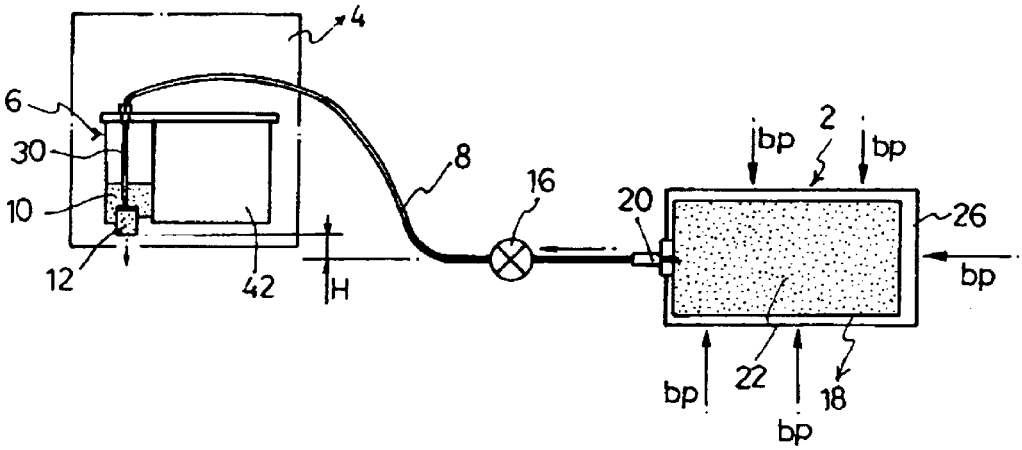
FIG. 1 PRIOR ART
FIG. 1 is a schematic diagram of the conventional automatic ink supply device.
Figure 2:
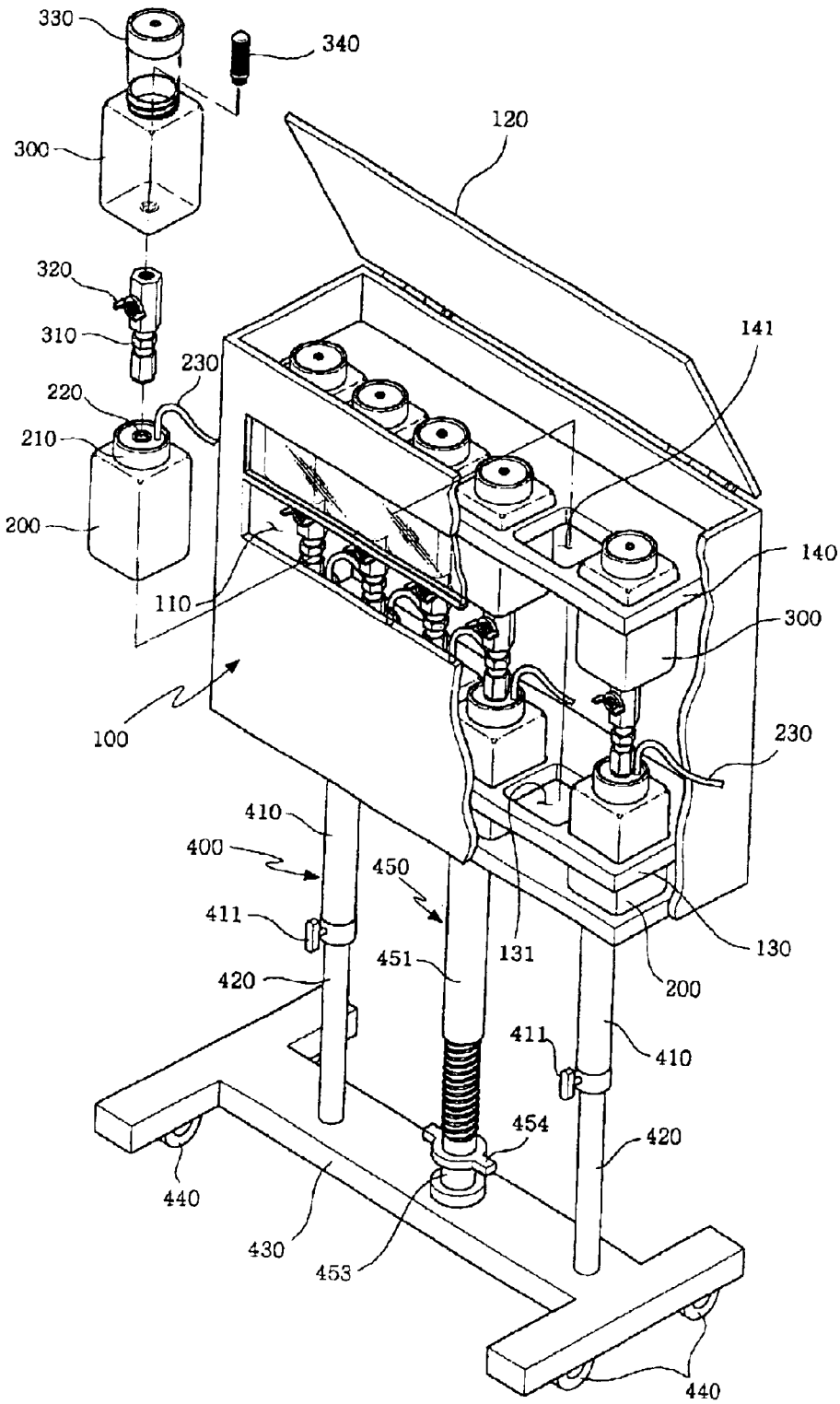
FIG. 2 is a partial sectional schematic diagram of an automatic ink supply device of the present invention.
Figure 3:
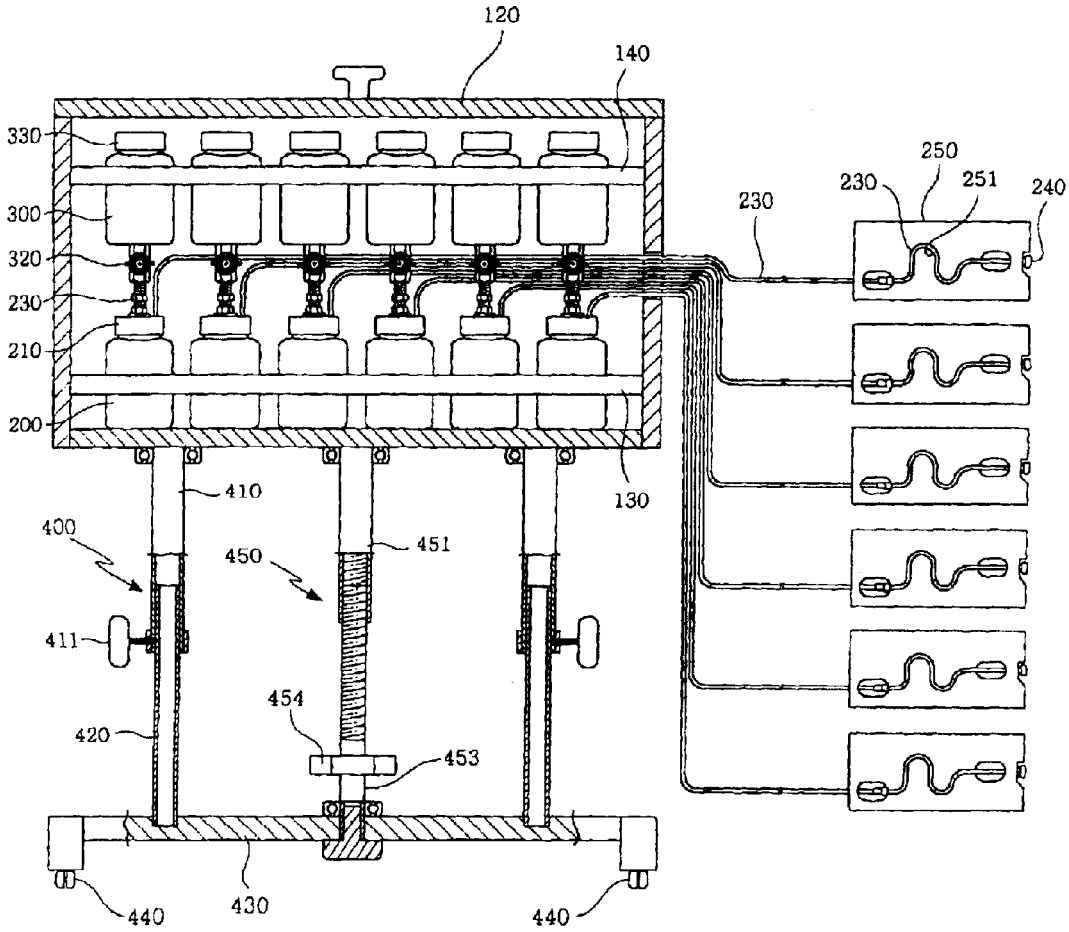
FIG. 3 is a cross sectional view of the automatic ink supply device of the present invention.
Figure 5:
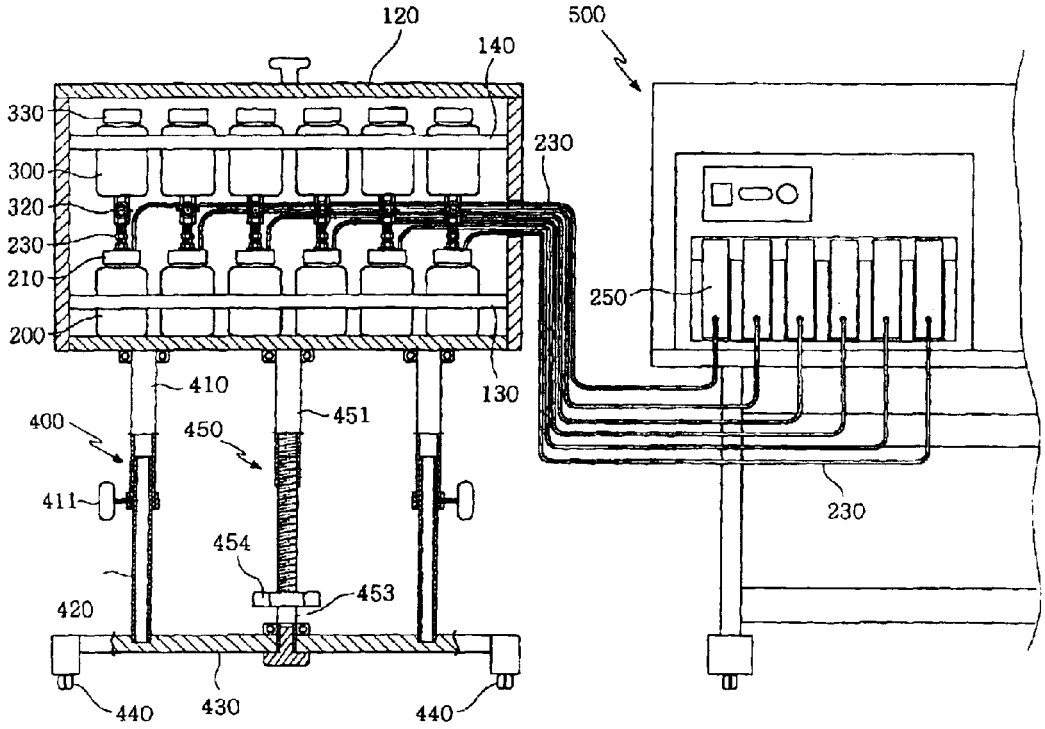
FIG. 5 is a front view of a printer and the automatic ink supply device according to the present invention.

According to the present invention, FIG. 2 is a partial sectional schematic diagram of an automatic ink supply device, and FIG. 3 is a cross sectional view of the automatic ink supply device. In more, FIG. 5 is a front view of a printer and the automatic ink supply device.

At first, a main body 100 installed adjacently to a printer 500, has a rectangle shape and comprises a long opening 110 horizontally in the front side of the main body 100. Preferably, the front said of the main body except the opening 110 is covered with transparent material, such as acryl. In more, the top side of the main body 100 comprises a body cover 120 opened or closed by rear hinge 120.

Additionally, in a predetermined height of the inside of the main body 100, the main body 100 comprises a bottom supporting plate 130 and a top supporting plate 140 including multiple supporting holes 131 and 141.

In more, multiple bottom tanks 200 penetrates each supporting hole 131 of the bottom supporting plate 130, and the bottom side of the multiple bottom tanks 200 is grounded to the bottom side of the main body 100. Each of the multiple bottom tanks 200 charged by color ink in a predetermined height, while the color inks are different from one another, has a cylindrical shape and a close cap 210 at the top side.

A hose hole 220 with a predetermined diameter is generated in the center of the close cap 210. In more, the length of a nozzle hose 230 installed in the one side of the close cap 220 is as long as from the bottom of the inner side of each of the multiple bottom tanks 200 to the printer 500 adjacent to the main body 100. Additionally, in the end of each of the nozzle hoses 230, each of the nozzles 240 connected to the printer 500 is installed.

The six bottom tanks 200 are usually installed, and each of the bottom tanks 200 contains color ink, such as cyan, yellow, magenta, black, light magenta, and light cyan, or specially selected color ink can be charged to the bottom tank 200. Therefore, combination of those colors can discharge various colors.

As shown in FIG. 2, in the case of connecting the end of the nozzle hose 230 with the nozzle 240 connected with the printer 500, a nozzle cartridge 250 having a same shape of the ink cartridge is generated. Sequentially, an installation groove 251 is generated in a nozzle cartridge 250 to fix the nozzle hose 230 in stable, and the one end of the nozzle cartridge 250 fixes the nozzle 240. In more, the nozzle hose 230 installed in the nozzle cartridge 250 can be set in the inside of the nozzle cartridge 250.

Figure 4:
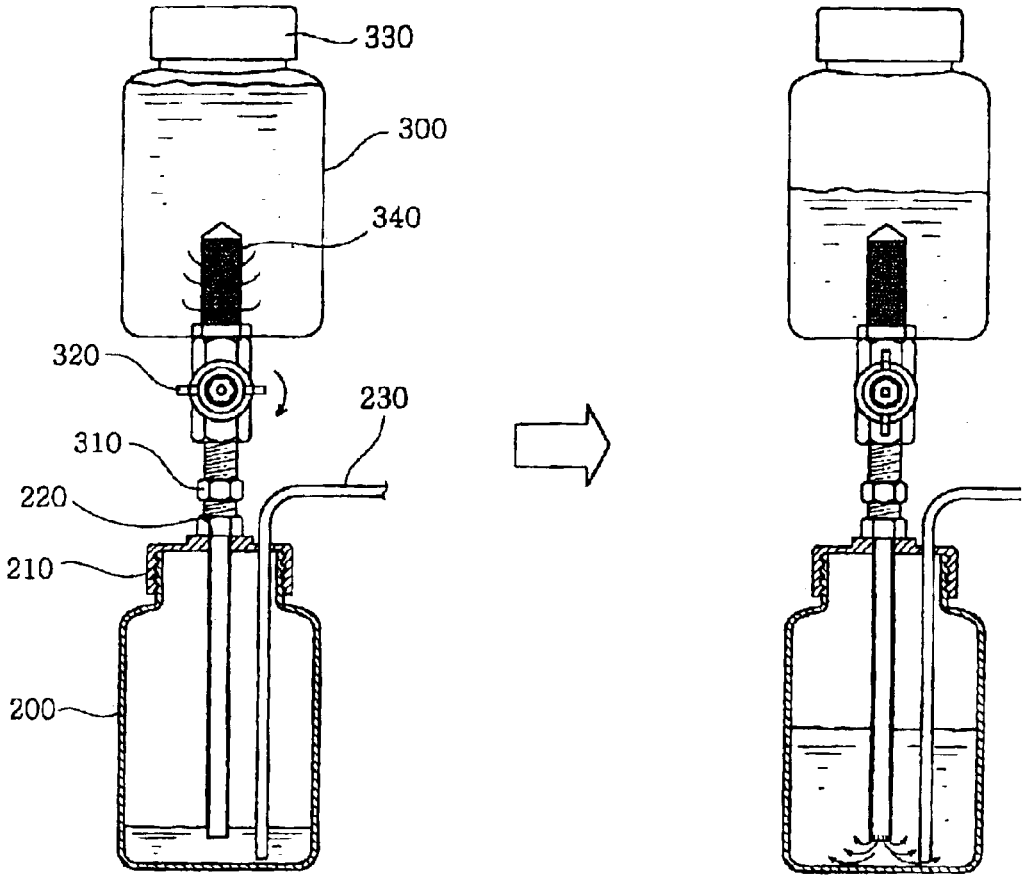
FIG. 4 is a cross sectional view illustrating a top tank and of a bottom tank mainly according to the present invention.

Each of six top tanks 300 corresponding to the same number of the bottom tanks 200 is installed in and penetrated into each of the supporting holes 141 of the top supporting plate 140, and is supplied by ink having different colors one another. In more, a supply hose 310 with an O/C (open/close) valve 320 is connected with the bottom of the top tank 300, and the bottom end of the supply hose 310 is prolonged to a predetermined height of the inside of the bottom tank 200 to maintain the amount of ink constantly, as shown in FIG. 4. Additionally, the top side of the top tank 300 comprises an O/C cover 330 receiving ink from the outside. The O/C valve 320 is exposed to the opening 110 in the front side of the main body 100 so that the O/C valve 320 can be controlled from the outside.

In more, the supply hose 310 positioned in the inside of the top tank 300 comprises a filter unit 340 filtering a foreign substance within the injected ink. The filter unit 340 has a minute size (about 10 $\mu$m) to prevent a water passage, and the ink is slowly passed by the surface tension and is supplied into the bottom tank 200.

On the contrary, in the bottom of the main body 100, a supporting rod 400 adjusting the height to fit on the height of the printer 500 is installed in a predetermined distance apart. The supporting rod 400 comprises two top supporting rods 410 in the bottom of the main body 100 in a distance, and a bottom supporting rod 420 is prepared and guided into the inside of each of the top supporting rods 410. In more, with the bottom side of the bottom supporting rod 420, a base plate 430 supporting the bottom supporting rod 420 in stable is connected.

Additionally, the one side of the two top supporting rods 410 comprises a fixing bolt 411, corresponding to the bottom supporting rod 420, to combine two supporting rod 410 and 420 in stable, and the base plate 430 comprises multiple casters 440 moving the main body 100 conveniently and easily.

In more, an elevating mean 450 lifting up and down the main body is installed between the supporting rods 400. The elevating mean 450 comprises a screw rod 451, a screw axis 453, and an adjusting handle 454. The screw rod 451 is placed in the center of the bottom of the main body 100 and the screw axis 453 is placed in the center of the base plate 430 rotating in the inside of the screw rod 451 in a fixed position to lift up and down the screw rod 451. In more, the adjusting handle 454 makes the rotation of the screw axis 453 easy. In other words, when the adjusting handle 454 is rotated, the screw axis 453 is rotated in a fixed position to lift up and down the screw rod 451, and the top supporting rod 410 is lifted up and down in stable from the bottom supporting rod 420 placed in both sides of the base plate 430.

Function and effects of the automatic ink supply device shown in the above will be described in the following statements.

At first, the automatic ink supply device is moved to the one side of the printer 500. In this case, the automatic ink supply device is moved easily because the caster 440 is installed in the bottom side of the base plate 430.

After moving the automatic ink supply device to the one side of the printer 500, the nozzle cartridge 250 combined with the nozzle hose 230 is installed in the cartridge chamber (not shown) in the one side of the printer 500, and the height of the main body 100 is adjusted. It is because ink supply to the printer is not performed well when the height of the main body 100 is less than that of printer 500.

To adjust the height of the main body 100, the fixing bolt 411 of the one side of the top supporting rod 410 is loosed to release the end of the fixing bolt 411 from the bottom supporting rod 420. Sequentially, the adjusting handle 454 is rotated in the one direction to rotate the screw axis 453 in a fixed position. In this case, the screw rod 451 and both top supporting rods 410 are lifted up due to the rotation of the screw axis 453. In more, the top side of the main body 100 is also lifted up adequately to match on the height of the printer 500. After adjusting the height of the main body 100, the fixing bolt 411 of the one side of the top supporting rod 410 is tightened to contact the end of the fixing bolt 411 with the bottom supporting rod 410 and to prevent the lift-up main body 100 from moving.

After adjusting the height of the main body 100 adequately, the body cover 120 installed in the top side of the main body 100 is opened. In this case, the body cover 120 is opened and supported by the rear hinge 121.

When the body cover 120 is opened, the O/C cover 330 of the top tank 300, normally six arranged inline, is opened and each of the top tanks 300 is charged with different color inks one another, such as cyan, yellow, magenta, black, light magenta, and light cyan.

The ink charged in the inside of the top tank 300 is supplied to the bottom tank 200 through the supply hose 310 by the surface tension. In this case, the open states of the O/C valve 320 installed in the supply hose 310 are maintained. Because the filter unit 340 is installed in the supply hose 310 placed in the inside of the top tank 300, a foreign substance within the ink or a lump of ink larger than a standard size (about 10 $\mu$m) is filtered to prevent closing of the nozzle 240 during the printing process.

As shown in FIG. 4, an atmospheric pressure is exerted to the ink supplied from the bottom tank 200 through the supply hose 310 prolonged to the inside of the bottom tank 200. Therefore, the height of the ink within the bottom tank 200 is maintained constantly, and the amount of the ink consumed in the bottom tank 200 is refilled from the top tank 300.

When the ink of the top tank 300 is consumed completely, the O/C valve 320 installed in the supply hose 310 is closed through the opening 110 in the front side of the main body 100, and adequate amount of ink is refilled to the top tank 300. Sequentially, the O/C valve 320 is opened again. When ink is refilled to the top tank 300 in the state of opening the O/C value 320, the difference of an atmospheric pressure is generated in the inside of the bottom tank 200. Therefore, such phenomena rises up the ink level in the inside of the bottom tank 200, and makes the amount of discharged ink through the nozzle 240 different to generate low printing quality.

As shown in the above statements, the automatic ink supply device of the present invention provides has a minimized volume to be installed easily. In more, the top tank and the bottom tank can supply ink continuously, while the bottom tank is connected with each of the multiple nozzle hoses and the top tank is connected with the bottom tank through the supply hose. Therefore, printing efficiency is maximized and supplying ink from the outside is performed easily.

Additionally, the height of the automatic ink supply device of the present invention can be adjusted in free to match on any height of the printer. In more, the filter unit installed in the inside of the top tank charged by ink from the outside filters a foreign substance or a lump of ink larger than a standard size to prevent closing of the nozzle to ensure high printing quality.

While the invention has been particularly shown and described with reference to preferred embodiments thereof, it will be understood by those skilled in the art that the foregoing and other changes in form and details may be made therein without departing from the spirit and scope of the invention.

What is claimed is:

1. An automatic ink supply device comprising:

a main body installed in the one side of a printer, including a bottom supporting plate and a top supporting plate of a predetermined height with multiple supporting holes in the inside of the main body;

multiple bottom tanks supported in stable in the state of penetrating the corresponding supporting holes of the bottom supporting plate, including a close cap in the top side, including a hose hole in the center of the close cap, including a nozzle hose from the inner bottom side of the close cap to the outside of the main body, and including a nozzle in the end of the corresponding nozzle hose connected to the printer, respectively; and multiple top tanks supplied by ink with different colors from one another in the state of penetrating the supporting holes of the top supporting plate, including a supply hose with an O/C (open/close) valve in the bottom side, maintaining an amount of charged ink constantly in the corresponding bottom tank by prolonging the bottom end of the supply hose to a predetermined height of the inside of the corresponding bottom tank, including an O/C (open/close) cover in the top side to receive ink from the outside, respectively.

2. The automatic ink supply device according to claim 1, further comprising a supporting rod in the bottom of the main body in a predetermined distance apart to be adjusted to match the height of the printer.

3. The automatic ink supply device according to claim 2, wherein the supporting rod further comprises:

a top supporting rod fixed in the bottom side of the main body;

a bottom supporting rod guided into the inside of the top supporting rod;

a base plate supporting the bottom supporting rod in stable; and a fixing bolt in the one side of the top supporting rod to be contacted with the bottom supporting rod.

4. The automatic ink supply device according to claim 2 comprising an elevating mean between the supporting rods to lift up and down the main body, wherein the elevating mean further comprises:

a screw rod in the bottom center of the main body;

a screw axis in the base plate to be rotated in a fixed position to the inside of the screw rod to lift up and down the screw rod; and a adjusting handle rotating the screw axis.

5. The automatic ink supply device according to claim 3, wherein the base plate further comprises multiple casters to move the main body easily.

6. The automatic ink supply device according to claim 1, further comprising a filter unit in a supply hose of the inside of the top tank to filter a foreign substance within the injected ink.

7. The automatic ink supply device according to claim 1, further comprising an opening to adjust the O/C valve from the outside of the front of the main body.

8. The automatic ink supply device according to claim 1, wherein the front side of the main body is covered with transparent material to identify the amount of ink charged in both top and bottom tanks.

9. The automatic ink supply device according to claim 1, wherein the top side of the maim body further comprises the body cover opened or closed by a rear hinge.

10. The automatic ink supply device according to claim 1, further connecting the end of the nozzle hose with the nozzle connected to the printer, wherein:

the shape of nozzle cartridge is the same of the shape of the ink cartridge;

the nozzle hose is fixed to the nozzle cartridge in stable; and the nozzle of the end of the nozzle hose is combined and fixed with the one end of the nozzle cartridge.

* * * * *